United States Patent [19]

Garay et al.

[11] Patent Number: 4,772,895

[45] Date of Patent: Sep. 20, 1988

[54] WIDE-BAND HELICAL ANTENNA

[75] Inventors: Oscar M. Garay, North Lauderdale; Quirino Balzano, Plantation, both of Fla.

[73] Assignee: Motorola, Inc., Schaumburg, Ill.

[21] Appl. No.: 61,504

[22] Filed: Jun. 15, 1987

[51] Int. Cl.[4] ..... H01Q 1/36

[52] U.S. Cl. ..... 343/895; 343/752

[58] Field of Search ..... 343/895, 790, 791, 749, 343/752, 827

[56] References Cited

U.S. PATENT DOCUMENTS

| | | | |
|---|---|---|---|
| 2,503,010 | 4/1950 | Tiley | 343/895 |
| 2,611,868 | 9/1952 | Marston et al. | 343/895 |
| 2,996,718 | 8/1961 | Foley | 343/825 |
| 3,852,759 | 12/1974 | Felsenheld et al. | 343/729 |
| 4,137,534 | 1/1979 | Goodnight | 343/752 |
| 4,148,030 | 4/1979 | Foldes | 343/895 |
| 4,169,267 | 9/1979 | Wong et al. | 343/895 |
| 4,229,743 | 10/1980 | Vo et al. | 343/749 |
| 4,442,438 | 4/1984 | Siwiak et al. | 343/792 |
| 4,490,727 | 12/1984 | Kowols | 343/895 |

*Primary Examiner*—William L. Sikes
*Assistant Examiner*—Hoanganh Le
*Attorney, Agent, or Firm*—Mark P. Kahler

[57] ABSTRACT

An antenna is provided which includes first and second helical elements which are separated by a dielectric spacer. The first helical element is fed a radio frequency driving signal and the remaining second element is coupled to ground. The first and second elements are coupled together in a fashion which results in a dramatic increase in antenna bandwidth in comparison to prior helical antennas.

4 Claims, 4 Drawing Sheets

—PRIOR ART—

—PRIOR ART—

—PRIOR ART—

—PRIOR ART—

WIDE-BAND HELICAL ANTENNA

BACKGROUND OF THE INVENTION

This invention relates in general to antennas for radiating electromagnetic signals. More particularly, the invention relates to helical antennas for portable radios and other communications equipment.

In the past, relatively large antennas such as the half wave dipole depicted in FIG. 1A were quite acceptable as antennas for low frequency fixed station transceivers. Such half-wave dipole antennas typically exhibit a reasonably broad bandwidth, as illustrated in the return loss vs. frequency graph of FIG. 1B. Unfortunately, if used on a hand-held portable radio, such a half-wave dipole is generally relatively large with respect to the size of the portable radio. The large size of such a dipole antenna often makes it undesirable for portable radio applications.

One solution to the above antenna size problem is to form each of the two quarter wave ($\lambda/4$) elements of the antenna of FIG. 1A into respective helices thus resulting in the helical antenna of FIG. 2A. Each helical element thus formed occupies significantly less space ($\lambda'/4$) than the corresponding element of the dipole of FIG. 1A, but desirably exhibits the same effective electrical length. Although such a helical antenna does result in a decrease in the effective height of the antenna structure employed on a portable radio, the usable bandwidth of the antenna is significantly less than that of the dipole antenna of FIG. 1A. This reduction of usable bandwidth is readily seen in the return loss vs. frequency graph of FIG. 2B for the antenna of FIG. 2A. Moreover, FIG. 3 shows a Smith Chart of the driving point impedance of the antenna of FIG. 2A which demonstrates the narrow banded nature of such a helical antenna.

Those skilled in the antenna arts appreciate that helical antennas generally exhibit a narrow bandwidth. This causes a problem when a particular portable radio is to operate over a relatively wide band of frequencies. For example, to cover the VHF band between 136 and 174 MHz, three or more conventional helical antennas cut to different frequencies must often be used.

BRIEF SUMMARY OF THE INVENTION

One object of the present invention is to provide an antenna which is sufficiently small to be used on portable radio devices.

Another object of the invention is to provide a antenna which is relatively small and yet exhibits a relatively wide bandwidth.

In one embodiment of the invention, an antenna is provided which includes a feed port with a signal feed portion and a ground portion. The antenna further includes a first helically configured conductive element having opposed ends, one end of which is coupled to the signal feed portion of the feed port. A second helically configured conductive element having opposed ends is wound around a portion of said first element. One end of the second element is coupled to the ground portion of the feed port. A spacer is situated between the first and second helical elements to electrically insulate the first and second elements. The spacer is sufficiently thin such that the first element is tightly coupled to the second element so as to broaden the frequency response exhibited by the first element.

The features of the invention believed to be novel are specifically set forth in the appended claims. However, the invention itself, both as to its structure and method of operation, may best be understood by referring to the following description and the accompanying drawings.

DETAILED DESCRIPTION OF THE INVENTION

Figure 4A:
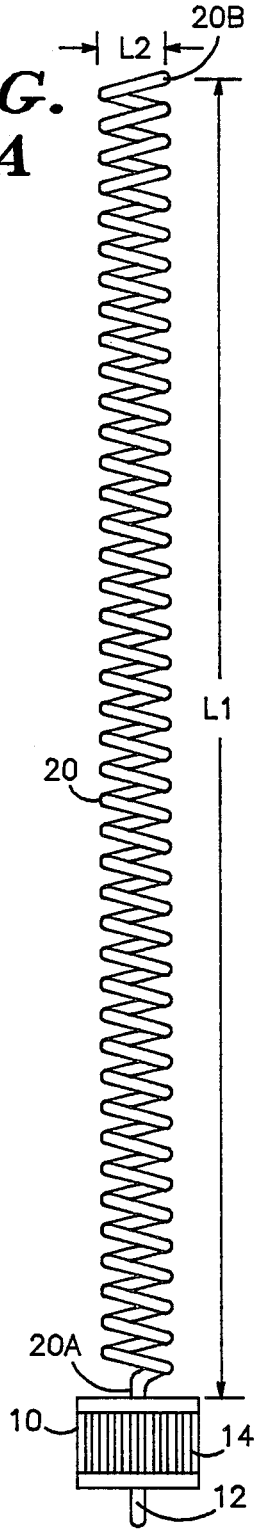
FIG. 4A is a representation of the helical antenna of the present invention in an early stage of fabrication.

Turning now to FIG. 4A, one embodiment of the antenna of the present invention is shown in an early stage of fabrication. Although the particular antenna disclosed herein operates in the 136–174 MHz VHF band and exhibits a center frequency of 155 MHz, those skilled in the art will appreciate that the dimensions which follow are given for purposes of example and may be scaled so that the antenna of the invention will operate in other frequency ranges as well.

The antenna of FIG. 4A includes a coaxial connector 10 having a center conductor 12 and a ground 14. The antenna further includes a primary resonator or element 20 having ends 20A and 20B, of which end 20A is coupled to the center conductor 12 of coaxial connector 10. End 20A and ground 14 together form the feedpoint of the antenna. Primary element 20 is helically wound as shown in FIG. 4A. The electrical length of element 20 is selected to be approximately 25% less than $\lambda/4$ wherein $\lambda$ is the wavelength corresponding to the desired center frequency of the antenna. In this particular example, the dimensions of primary element 20 are selected such that element 20 resonates at approximately 115 MHz. Element 20 exhibits a physical length L1 wherein L1 is 22 cm in this example. The diameter L2 of element 20 is approximately 7 mm. The helix formed by element 20 exhibits a pitch of approximately 3.2 turns per cm (approximately 8 turns per inch ) in this example.

Figure 4B:
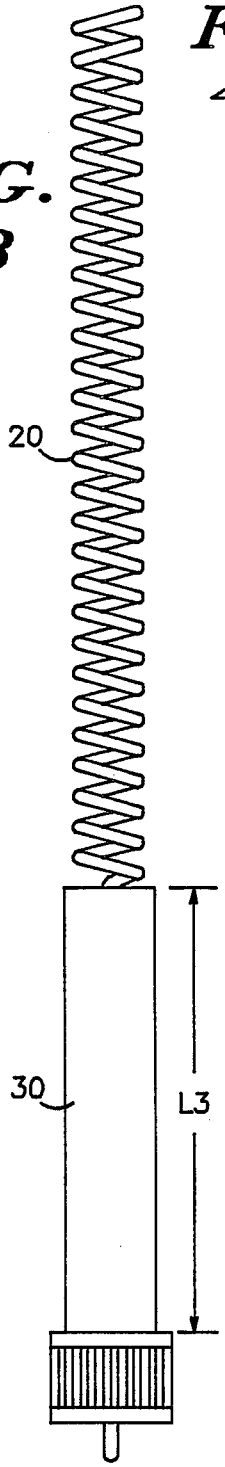
FIG. 4B is a representation of the helical antenna of the invention in a more advanced stage of fabrication.

A cylindrical dielectric spacer 30 is situated over the lower portion of element 20 near connector 10 as shown in FIG. 4B. Spacer 30 is coaxially situated with respect to element 20. The length, L3, of spacer 30 is selected to be sufficiently long to insulate secondary element 40 (described later in the discussion of FIG. 4C) from primary element 20. For example, in this embodiment L3 is approximately 7 cm. Spacer 30 is fabricated from low dielectric constant materials such as plastic, insulative shrink tubing material, Teflon TM material or other similar electrically insulative materials.

Figure 4C:
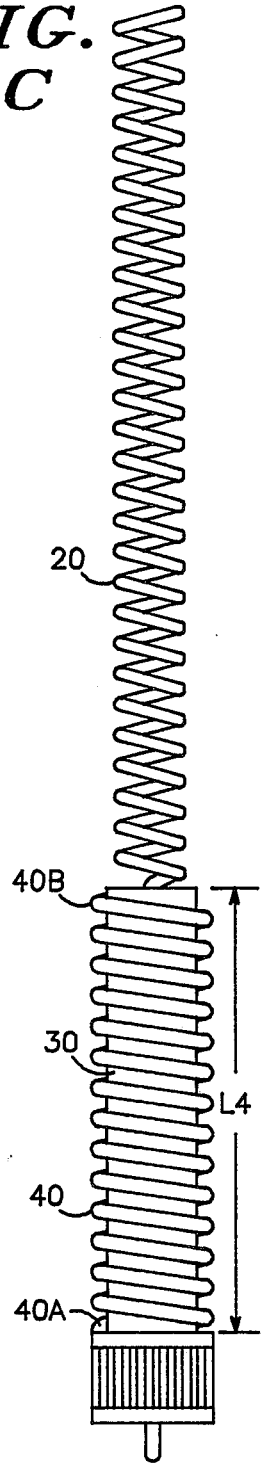
FIG. 4C is a representation of the helical antenna of the invention.

FIG. 4C shows the assembled antenna as including a secondary resonator or element 40 having ends 40A and 40B. Secondary element end 40A is coupled to the ground portion 14 of connector 10. Secondary element 40 is helically wound around primary element 20 and spacer 30 as shown. In one embodiment of the antenna, the pitch of primary element 20 is approximately twice that of secondary element 40. That is, primary element 20 exhibits approximately twice as many turns per cm as secondary element 40. For example, in this embodiment of the antenna, the pitch of element 40 is approximately 1.6 turns per cm (approximately 4 turns per inch). It is noted that secondary element 40 is coaxially aligned with respect to primary element 20. It is further noted that primary element 20 is substantially longer than secondary element 40 as described in more detail subsequently.

The thickness of spacer 30 is selected to be sufficiently small such that secondary element 40 is tightly coupled, capacitively and inductively, to primary element 20. For example, thicknesses of spacer 30 (outer diameter minus inner diameter) within the range of approximately 0.25 mm to approximately 0.3 mm will perform acceptably although thicknesses of spacer 30 somewhat smaller or larger than this range will perform acceptably as long as tight coupling between primary element 20 and secondary element 40 is maintained.

The physical length, L4, of secondary element 40 is equal to approximately 7 cm in this example. The electrical length of secondary element 40 is selected to be approximately equal to one third of the electrical length of primary element 20. Stated alternatively, the resonant frequency of secondary element 40 is approximately three times the resonant frequency of primary element 20. For example, in the present embodiment, primary element 20 is cut to a length L1 which exhibits a resonant frequency of approximately 115 MHz and secondary element 40 is cut to a length L4 which exhibits a resonant frequency of approximately 356 MHz. It is noted that when the resonant frequency of elements 20 or 40 is discussed, we are referring to resonant frequency of each element by itself in free space. That is, such resonance is determined by measuring the resonant frequency of each element prior to assembly of the antenna. In this manner, the resonant frequency of the element is determined prior to coupling to other structures. As described above, it has been found that tightly coupling secondary element 40 to primary element 20 in the region of the feedpoint results in an antenna which exhibits a center frequency of 155 MHz and which exhibits significantly increased bandwidth (20% bandwidth at 10 dB return loss).

It was found that the pitch and the length L4 of secondary element 40 affect the degree of coupling between primary element 20 and secondary element 40. That is, increasing the pitch (turns per cm) of secondary element 40 increases the coupling between primary element 20 and secondary element 40. It is also noted that increasing the length L4 of secondary element 40 increases the coupling between primary element 20 an secondary element 40. Those skilled in the antenna arts will appreciate that the pitch of element 40 and length L4 of element 40 may be varied from the dimensions given. It was found that for the 155 MHz center frequency antenna example discussed above, secondary element 40 may exhibit pitches within the range of approximately 1.4 turns per cm to approximately 1.8 turns per cm, although other pitches may be employed providing elements 20 and 40 remain tightly coupled. Generally, if the length L4 of secondary element 40 is increased or decreased, then the length of primary element 20 is should be similarly increased or decreased to compensate for the change in length. The alteration of the lengths of elements 20 and 40 will generally change the center frequency of the antenna.

A housing of soft rubber or similar material (not shown) may be molded or otherwise used to cover the antenna of FIG. 4C in the same manner that such housings are used in other "rubber duck" type antennas employed on portable radios. Those skilled in the antenna arts are very familiar with the application of such housings to helical antennas. Since the antenna performs best when the dielectric material within primary element 20 is air, care should be taken when a housing is molded onto the antenna of FIG. 4C that the molding material does not enter the interior of primary element 20.

Figure 1A:
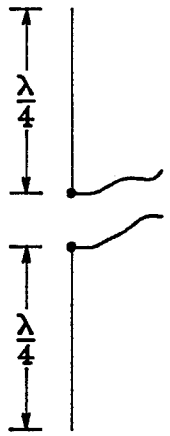
FIG. 1A is a representation of a conventional half-wave dipole antenna.
Figure 1B:
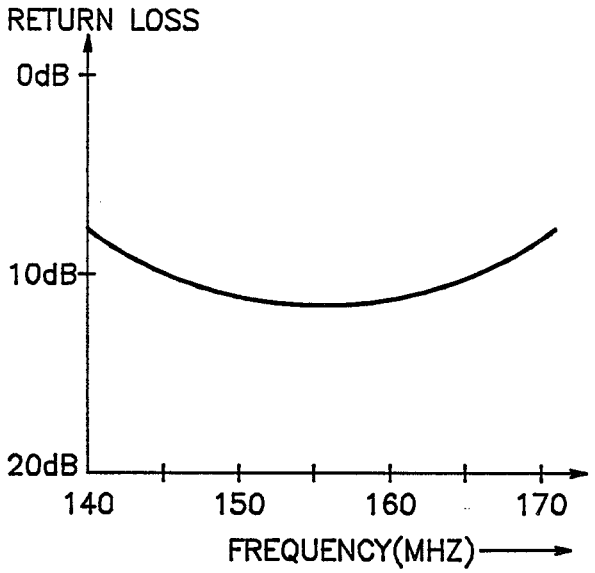
FIG. 1B is a return loss vs. frequency graph of the antenna of FIG. 1A.
Figure 2A:
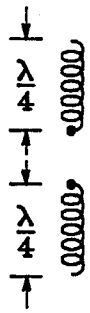
FIG. 2A is a representation of a half-wave helical antenna.
Figure 2B:
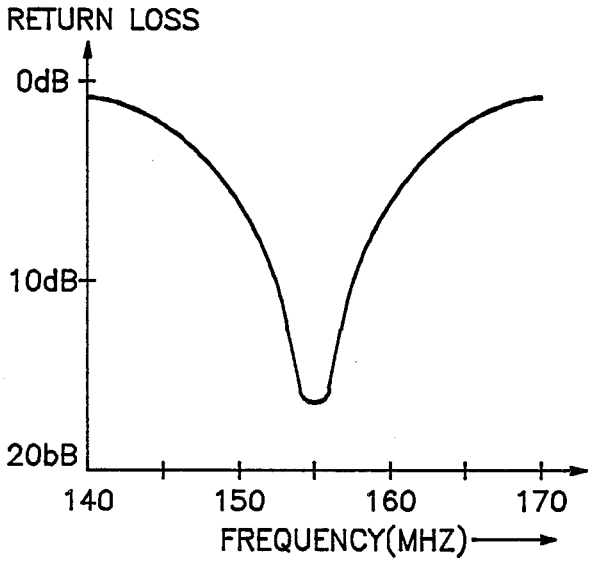
FIG. 2B is a return loss vs. frequency graph of the antenna of FIG. 2A.
Figure 3:
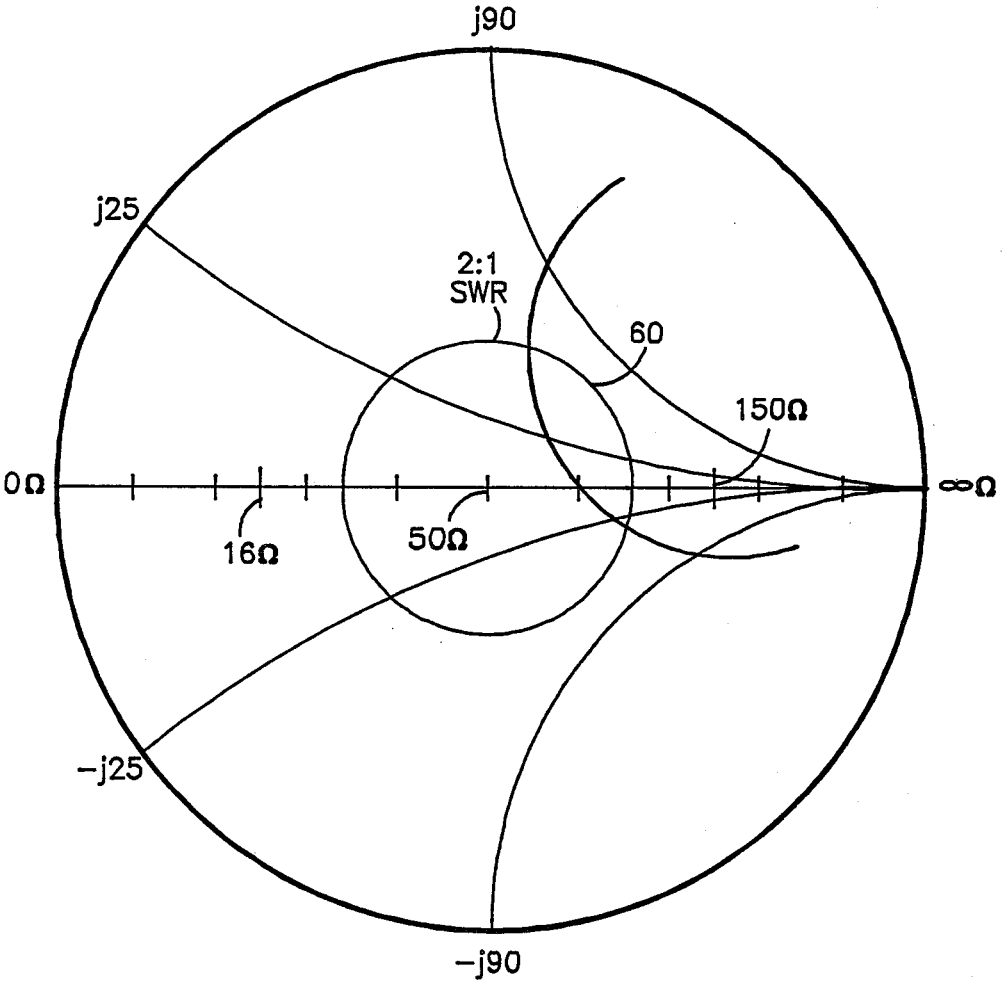
FIG. 3 is a Smith Chart plot of the driving point impedance of a conventional helical dipole antenna such as the antenna of FIG. 2A.
Figure 5:
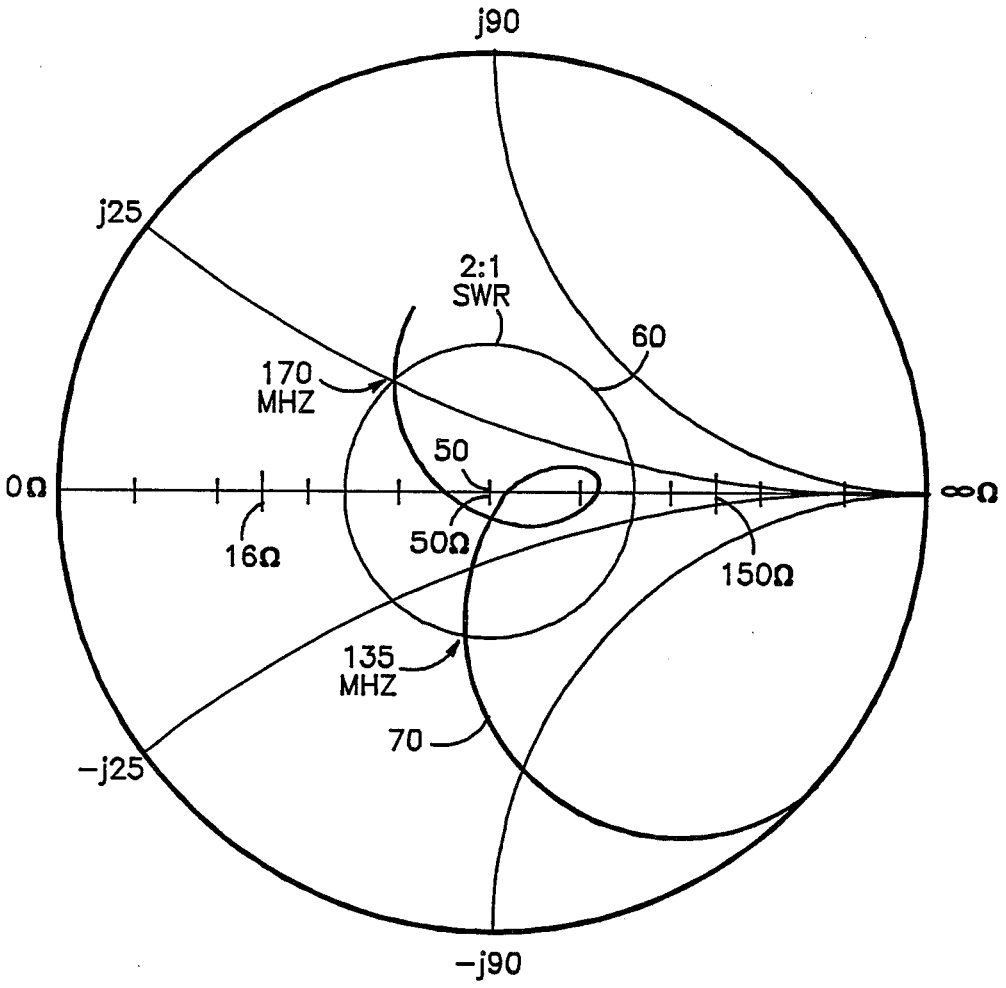
FIG. 5 is a Smith Chart plot of the driving point impedance of the helical antenna of the present invention.

FIG. 5 is a Smith Chart of the driving point impedance of the antenna of FIG. 4C. The center point of the Smith Chart is located at 50 and corresponds to 50 ohms. The plotted circle 60 represents the 2:1 SWR (standing wave ratio) circle. That is, all points within circle 60 exhibit an acceptable SWR which is less that 2:1. Curve 70 is the actual plot of the driving point impedance vs. frequency for the antenna of FIG. 4C. It is noted that for frequencies between 135 MHz and 170 MHz, the SWR remains less than 2:1 which indicates a significantly more broadband antenna than the conventional helical antenna whose driving point impedance as a function of frequency was illustrated in FIG. 3.

The foregoing describes an antenna which is sufficiently small to be used on portable radio devices. Despite the small size of the antenna, it exhibits a relatively wide bandwidth.

While only certain preferred features of the invention have been shown by way of illustration, many modifications and changes will occur to those skilled in the art. For example, it was also found that for the 155 MHz center frequency antenna example discussed above, primary element 40 may exhibit a physical length L1 different than that of the example. Those skilled in the antenna arts will appreciate that if a longer primary element 40 is desired, then secondary element 40 (L4) is appropriately lengthened as well. Other modifications are also possible keeping within the spirit of the invention. For example, while it is generally desirable to have the thickness (outer diameter minus inner diameter) of spacer 30 be as small as possible to maximize the coupling between primary element 20 and secondary element 40, the thickness of spacer 30 may be somewhat larger than in the example above. However, as the thickness of spacer 30 is increased, the length and pitch of element 40 should be increased to compensate for the loss of coupling between element 20 and element 40 which would otherwise occur.

Those skilled in the art also appreciate that although in the above example, the center frequency of the antenna is 155 MHz the dimensions of the antenna may be scaled up or down to fabricate an antenna which exhibits a center frequency which is less than or greater than 155 MHz as desired. These and other modifications will become apparent to those skilled in the art. It is, therefore, to be understood that the present claims are intended to cover all such modifications and changes which fall within the true spirit of the invention.

We claim:

1. An antenna comprising:

a feed port including a signal feed portion and a ground portion;

a first helically configured conductive element having opposed ends and exhibiting a first pitch and a first electrical length, one end of said first element being coupled to the signal feed portion of said feed port;

a second helically configured conductive element having opposed ends, and exhibiting a second pitch and a second electrical length, said second element being coaxially wound around a portion of said first element, one end of said second element being coupled to the ground portion of said feed port, said second pitch being equal to approximately one half of said first pitch, said second electrical length being equal to approximately one third of said first electrical length, and cylindrical spacer means, coaxially situated between said first and second elements, for electrically insulating said first and second elements, said spacer means being sufficiently thin such that said first element is tightly coupled to said second element so as to broaden the frequency response exhibited by said first element.

2. The antenna of claim 1 wherein said spacer means is comprised of dielectric material.

3. The antenna of claim 1 wherein the length of said second element is selected such that said second element exhibits a resonance offset in frequency from the resonance of said first element.

4. The antenna of claim 1 wherein the second element resonates at a frequency approximately three times the resonant frequency of the first element.

* * * * *